US007766704B2

(12) United States Patent
Robinson et al.

(10) Patent No.: US 7,766,704 B2
(45) Date of Patent: Aug. 3, 2010

(54) LAY-IN LUG NUT PLATE RETAINER

(75) Inventors: Kristopher Scott Robinson, Atlanta, GA (US); James R. Tirrell, Palmyra, VA (US); Brian J. Rusch, Norcross, GA (US)

(73) Assignee: Siemens Industry, Inc., Alpharetta, GA (US)

( * ) Notice: Subject to any disclaimer, the term of this patent is extended or adjusted under 35 U.S.C. 154(b) by 264 days.

(21) Appl. No.: 12/150,803

(22) Filed: May 1, 2008

(65) Prior Publication Data

US 2009/0047845 A1 Feb. 19, 2009

Related U.S. Application Data

(60) Provisional application No. 60/955,982, filed on Aug. 15, 2007.

(51) Int. Cl.
*H01R 4/36* (2006.01)

(52) U.S. Cl. ..... 439/814

(58) Field of Classification Search ..... None
See application file for complete search history.

(56) References Cited

U.S. PATENT DOCUMENTS 3,133,781 A * 5/1964 Rys et al. ..... 439/814
3,335,399 A * 8/1967 Rys ..... 439/739
3,742,431 A * 6/1973 Kobryner ..... 439/814
3,864,005 A * 2/1975 Klein ..... 439/812
3,876,279 A * 4/1975 Underwood ..... 439/797
3,891,298 A * 6/1975 Yorgin et al. ..... 439/620.08
4,053,202 A * 10/1977 Norden ..... 439/814
4,059,335 A * 11/1977 Simon ..... 439/813
4,090,029 A 5/1978 Lundeberg
4,248,490 A 2/1981 Bachle
4,355,852 A 10/1982 Bachle
4,427,258 A * 1/1984 Mueller ..... 439/814
4,457,577 A 7/1984 Browne et al.
4,603,376 A * 7/1986 Maier ..... 361/824
4,629,281 A * 12/1986 Kruger ..... 439/791
4,632,477 A 12/1986 Alger
4,806,108 A 2/1989 Meinhardt
4,809,132 A * 2/1989 Palmieri et al. ..... 361/634
4,929,198 A * 5/1990 Strate et al. ..... 439/709
5,005,104 A * 4/1991 Grunert et al. ..... 361/637
5,269,710 A * 12/1993 Donnerstag ..... 439/810
5,368,506 A * 11/1994 Heimbrock ..... 439/813
5,493,085 A * 2/1996 Kolberg et al. ..... 200/51 R
6,099,344 A * 8/2000 Chadbourne ..... 439/416

(Continued)

*Primary Examiner*—Ross N Gushi
(74) *Attorney, Agent, or Firm*—Jose de la Rosa

(57) ABSTRACT

A lay-in lug has two spaced apart and substantially parallel lug walls. A nut plate is supported between the first lug wall and the second lug wall. A plate retainer exerts force on a lug wall and restricts the plate from moving in a direction substantially parallel to the first and second lug walls. The plate retainer has a flexible retaining base and a pair of retaining legs extending from the retaining base. Snap protrusions extend from each of the retaining legs and are formed to interlock with a portion of the wall of the lay-in lug and restrict movement the nut plate. The plate retainer either snaps around the edge of the lug wall or along the wall's length. It may also clip around the nut plate and prevents its movement in a direction along the inner surfaces of the lug walls.

19 Claims, 7 Drawing Sheets

U.S. PATENT DOCUMENTS 6,612,879 B1 * 9/2003 Zahnen ..... 439/798
6,663,443 B1 * 12/2003 Smith et al. ..... 439/811
6,971,926 B1 * 12/2005 Walton ..... 439/798
7,338,333 B2 * 3/2008 Norden ..... 439/814
7,473,147 B2 * 1/2009 Zahnen ..... 439/798
2005/0202732 A1 * 9/2005 Rizzo et al. ..... 439/810
2006/0276084 A1 * 12/2006 Norden ..... 439/814

* cited by examiner

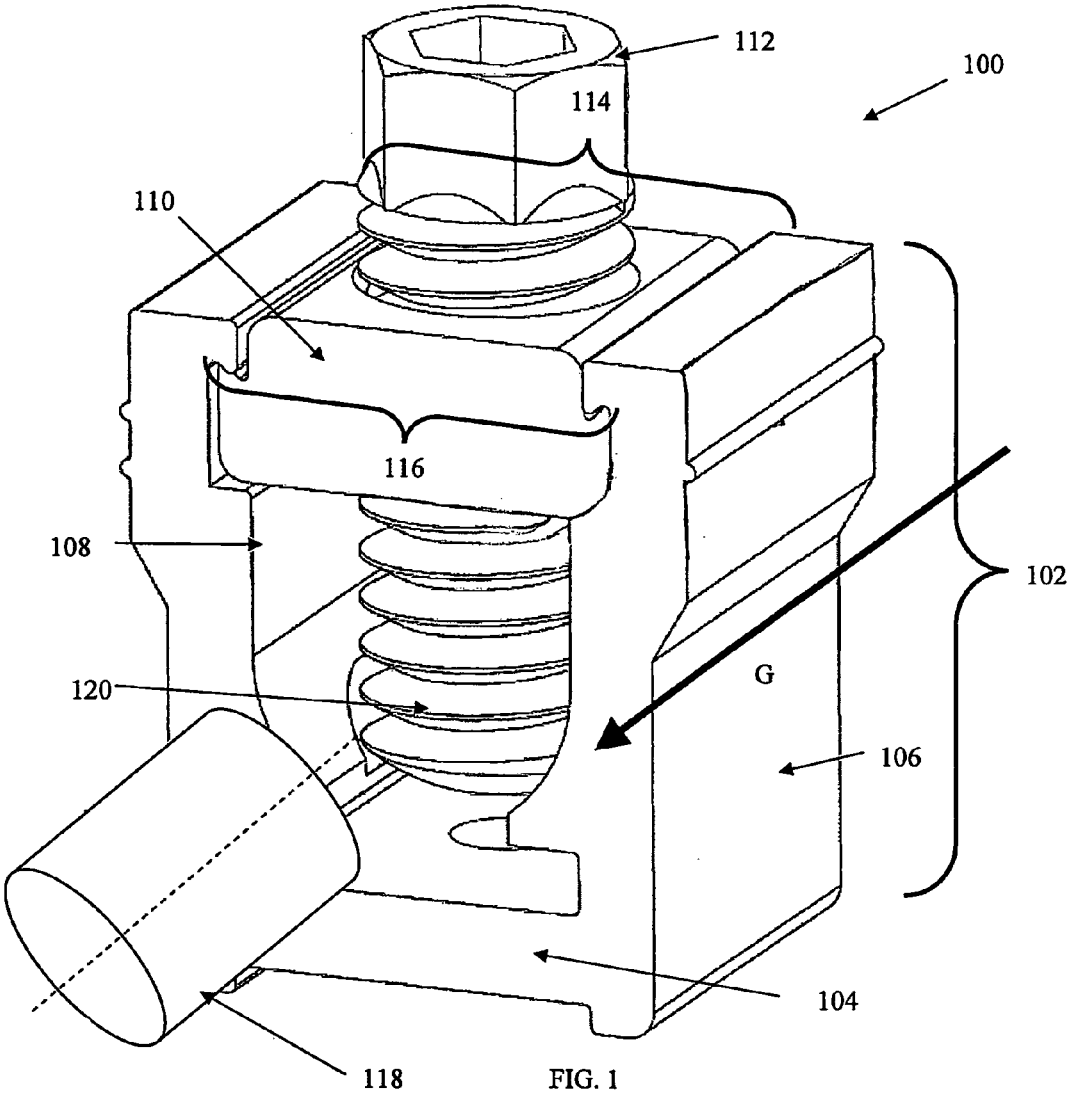
FIG. 1
(Prior Art)
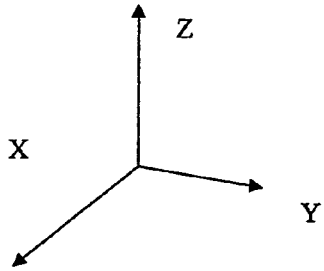

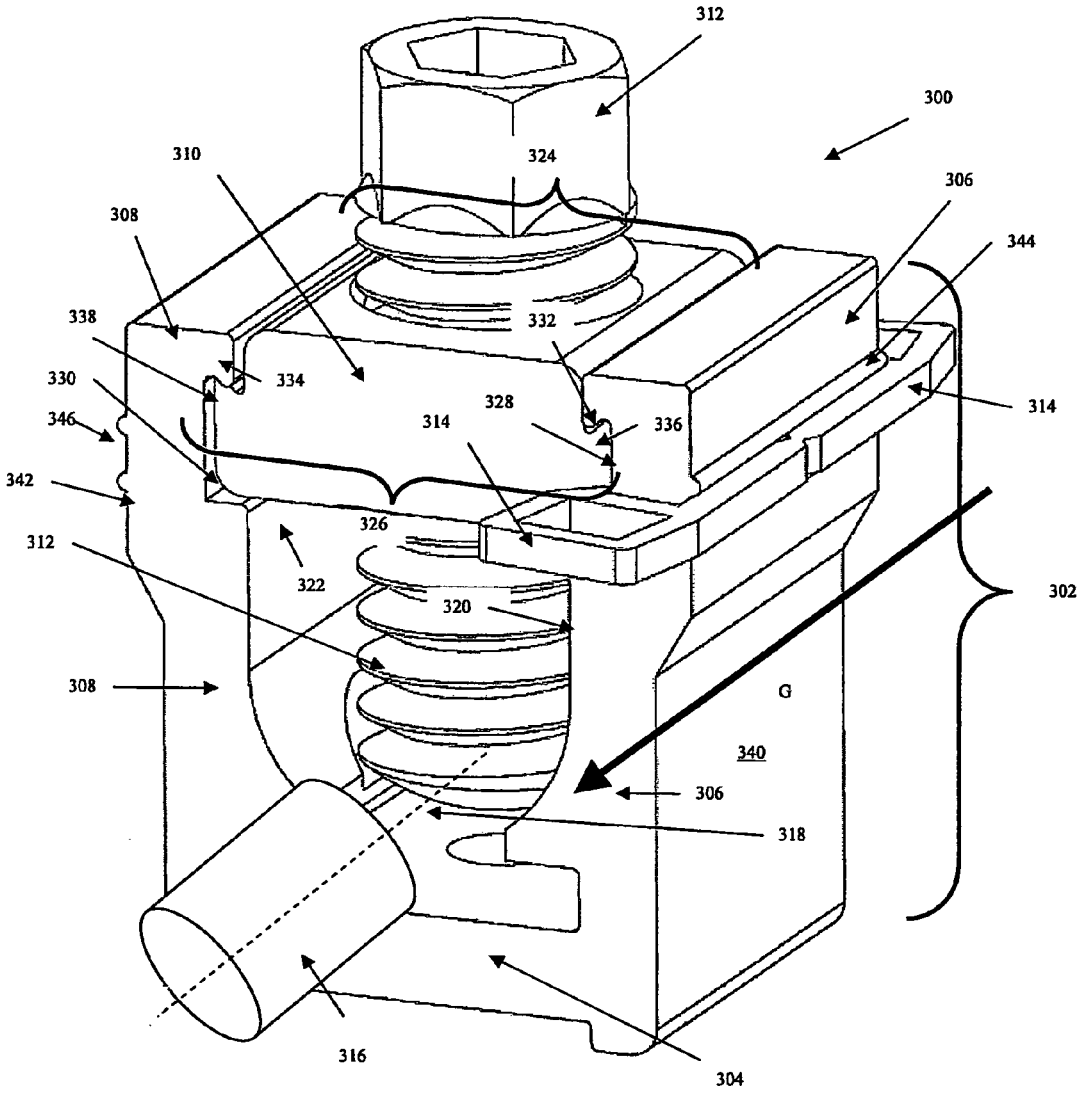
FIG. 3
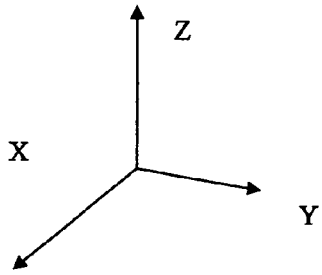

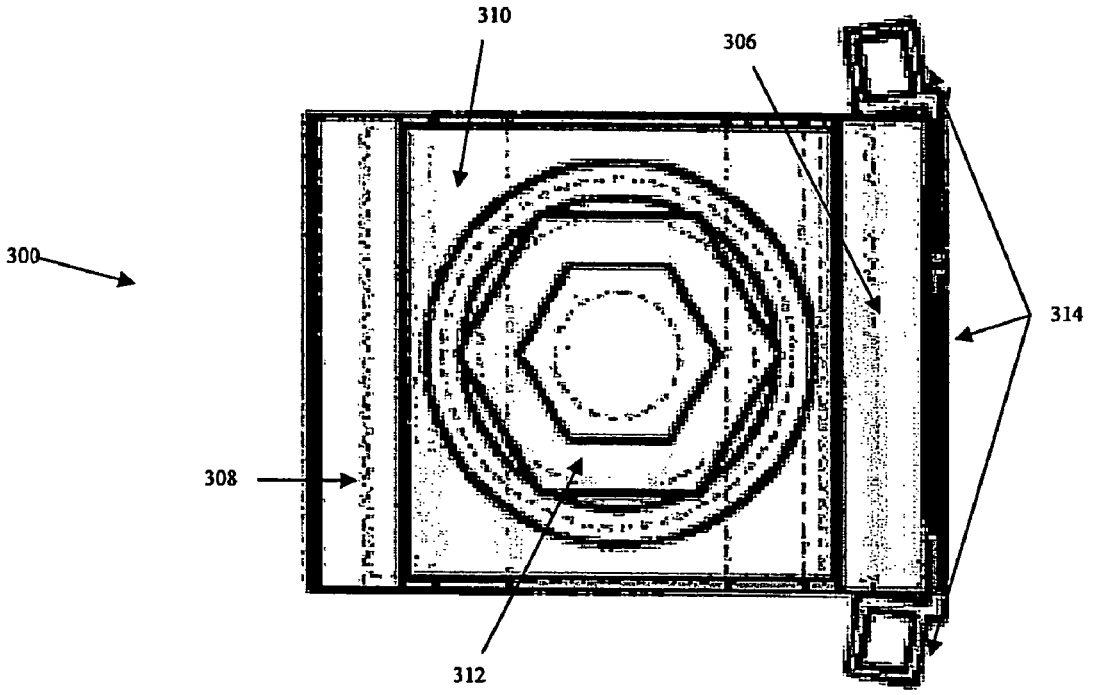
FIG. 4
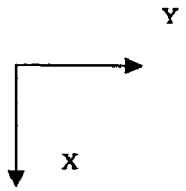

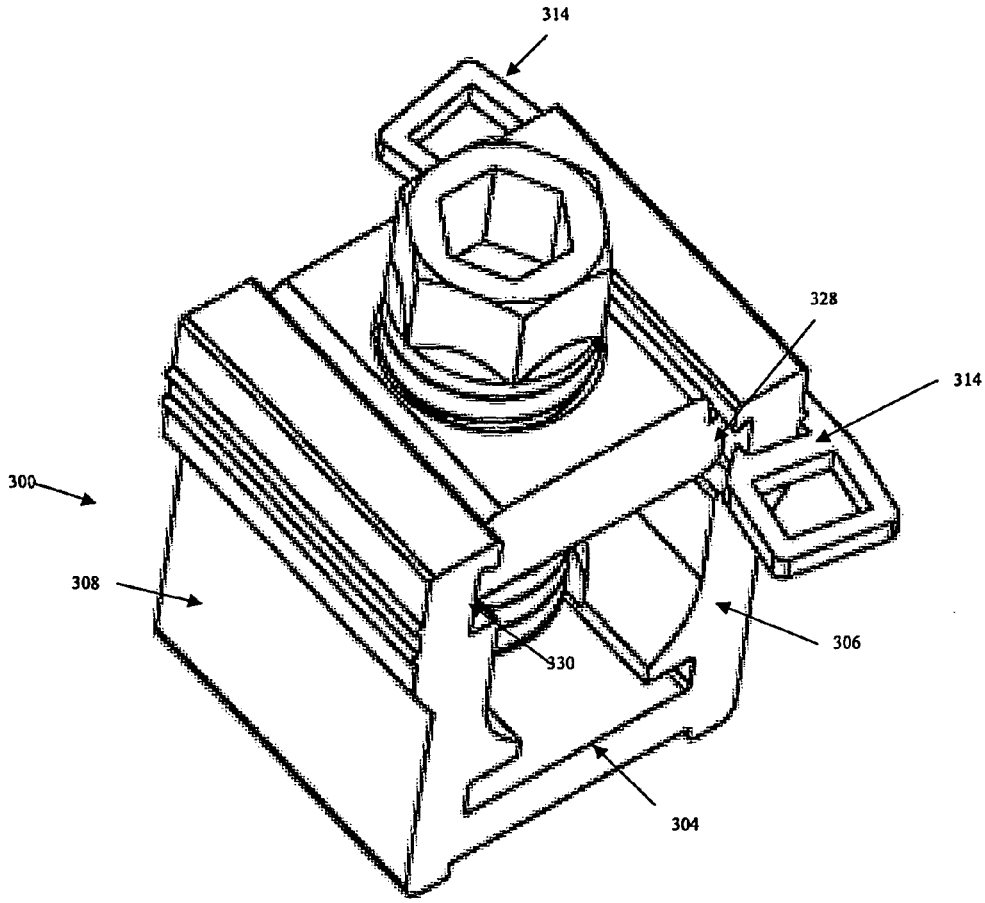
FIG. 5
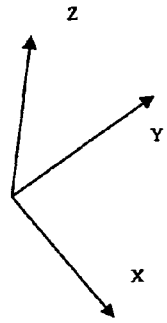

LAY-IN LUG NUT PLATE RETAINER

This application claims the benefit of U.S. Provisional Application No. 60/955,982 filed Aug. 15, 2007, which is incorporated herein by reference.

BACKGROUND OF THE INVENTION

The present invention relates generally to lay-in lugs and more particularly to techniques for securing a nut plate of a lay-in lug.

Lay-in lugs are similar to "C" or "J" type lugs, as are known, and are used to secure wires (e.g., electrical cables, wiring, tubing, etc.). Lay-in lugs are often used in electrical and similar applications to electrically connect service and/or feed phase-neutral conductors to electrical metering equipment and/or circuit protection. Lay-in lugs may be used in piping systems, such as electrical conduits and the like, to secure wires transposed vertically in a shaft, such as an electrical conduit riser. That is, lay-in lugs are used to hold (e.g., hang) wires vertically.

FIG. 1 is a front perspective view of an exemplary lay-in lug 100 as is known. Lay-in lug 100 has a lug body 102 comprising a base 104 and two opposed and substantially parallel vertical lug walls 106, 108. Supported between and/or atop lug walls 106 and 108 is a removable nut plate 110, which secures a wire binding screw 112.

In use (e.g., in an installation operation), lay-in lug 100 is secured to a surface (not shown) at its base 104. In vertical installation operations, lay-in lug 100 is secured such that the "open" ends 114 and 116 (e.g., sides of lug body 102 not dominated by a lug wall 106, 108) face substantially up and down, respectively (e.g., toward negative X and positive X, respectively). That is, lug walls 106 and 108 will be generally parallel to the direction of a gravity vector G and a secured wire 118. Nut plate 110, with wire binding screw 112 secured thereto, is removed from between lug walls 106, 108. This provides top down (e.g., positive Z to negative Z) access to the center channel 120 of lug body 102. Wire 118 (e.g., electrical cable, wiring, etc.) is laid in, pulled through, or otherwise transposed in the center channel 120 of lug body 102 between lugs walls 106 and 108, generally along the X axis. Nut plate 110 is returned to placement between and/or on top of lug walls 106, 108 and wire binding screw 112 is torqued (e.g., screwed, driven, etc.) to secure wire 118 between base 104 and wire binding screw 112 in the Z direction. Wire 118 is, of course, further secured laterally (e.g., in the Y direction) by lug walls 106, 108.

FIG. 2 depicts a top-front perspective exploded view of another known lay-in lug 200. Lay-in lug 200 is similar to lay-in lug 100 and has a lug body 202 having a lug base 204 and a pair of generally parallel, opposed lug walls 206 and 208. Lay-in lug 200 also has a nut plate 210 (e.g., a lug cap, top, etc.) attachable to the lug body 202 for capture of a wire 118 (e.g., electrical cable, etc.) with wire binding screw 212. As with lay-in lug 100, lay-in lug 200 has "open" ends 214 and 216 and nut plate 210 may be moved along an axis aligned between open ends 214, 216 (e.g., the X axis). The nut plate 210 of lay-in lug 200 has a pair of generally parallel nut plate ears 218 and 220 and respective nut plate flanges 222 and 224. As shown in FIG. 2, each of the nut plate flanges 222, 224 engages a respective lug body flange 226, 228 of the lug body 202. Such flange arrangements, as well as similar ridged arrangements, are used to secure nut plates (e.g., nut plates 110, 210, etc.) to lug bodies (e.g., lug bodies 102, 202, etc.) in a vertical (e.g., Z) direction.

For simplification of discussion, the XYZ axes of FIGS. 1 and 2, as well as FIGS. 3-6 below, may be assumed to be fixed to the lugs 100, 200, 300. Though lugs 100, 200, 300 may be oriented in other manners in real world applications, the lugs 100, 200, 300 are described as non-rotating within the coordinate system. For example, in the context of the present application, the Z axis always refers to the "up-and-down" direction extending through nut plates 110, 210, 310 and bases 104, 204, 304, irrespective of whether lugs 100, 200, 300 are placed on a "ground" surface, mounted to a wall, or are otherwise differently oriented.

The top-down (e.g., Z axis) access simplifies installation of wire 118 over prior "C" or "J" type lugs, but introduces a moveable and easily lost component—nut plate 110/210 with wire binding screw 112/212 attached. That is, since nut plate 110/210 is slideable and removable with respect to the rest of lug 100/200, nut plate 110/210 may inadvertently slide away from lug walls 106/206, 108/208 in transit and/or in installation. This is especially probable and problematic during the aforementioned electrical conduit riser type installation. Since the open end 116/216 of lug body 102/202 faces downward along the X axis (e.g., towards the ground or bottom and generally in the same direction as gravity vector G), nut plate 110/210 is not secured in lug body 102/202 in the vertical (e.g., up and down, along the X axis, etc.) direction and may slide or otherwise fall out due to the force of gravity exerted on nut plate 110/210 and wire binding screw 112/212.

Efforts have been made to prevent loss of nut plate 110/210 and wire binding screw 112/212. Generally, wire binding screw 112/212 is driven (e.g., screwed) through nut plate 110/210 far enough that wire binding screw 112/212 passes through center channel 120 (similarly in FIG. 2) and is bound in lug base 104/204. Lug Body 102/202 may have to be additionally machined to have a counterbore to allow wire binding screw 112/212 to be driven into base 104/204. With the wire binding screw 112/212 driven to contact or otherwise engage (e.g., be limited by) base 104/204, nut plate 110/210 is bi-directionally secured along the X axis and will not slide out as it is constrained in the Y and Z axes by the lug walls 106/206, 108/208 and in the X axis by the interaction of wire binding screw 112/212 with base 104/204. Wire binding screw 112/212 may also engage inner vertical lug walls 106/206, 108/208 (e.g., as with a counterbore, etc.).

These efforts fall short in that wire binding screw 112/212 must be used to secure nut plate 110/210 in the X axis. This is not useful during the installation operations described above because the wire binding screw 112/212 must be disengaged from the base 104/204 when nut plate 110/210 is removed to lay wire 118. During replacement of the nut plate 110/210, gravitational forces act on the nut plate 110/210 in the X direction and the nut plate 110/210 and the wire binding screw 112/212 may fall before the wire binding screw 112/212 is biased against the wire 118 and nut plate 110/210 interacts with the lug walls 106/206, 108/208 (e.g., at flanges 218, 220, 222, and 224 and similarly in lug 100).

Therefore, alternative methods and apparatus are required to secure nut plates in lay-in lugs.

BRIEF SUMMARY OF THE INVENTION

The present invention provides apparatus for securing nut plates in lay-in lugs.

A lay-in lug has two spaced apart and substantially parallel lug walls. A nut plate is supported between the first lug wall and the second lug wall. A plate retainer exerts force on a lug wall and restricts the plate from moving in a direction substantially parallel to the first and second lug walls. The plate retainer has a flexible retaining base and a pair of retaining legs extending from the retaining base. Snap protrusions extend from each of the retaining legs and are formed to interlock with a portion of the wall of the lay-in lug and restrict movement the nut plate. The plate retainer either snaps around the edge of the lug wall or along the wall's length. It may also clip around the nut plate and prevents its movement in a direction along the inner surfaces of the lug walls.

These and other advantages of the invention will be apparent to those of ordinary skill in the art by reference to the following detailed description and the accompanying drawings.

BRIEF DESCRIPTION OF THE DRAWINGS

FIG. 1 is a front perspective view of a prior art lay-in lug;

FIG. 3 is a front perspective view of a lay-in lug according to an embodiment of the invention;

FIG. 4 is a top view of the lay-in lug according to an embodiment of the invention;

FIG. 5 is top-front perspective view of the lay-in lug according to an embodiment of the invention;

DETAILED DESCRIPTION

The present invention generally provides apparatus for securing nut plates in lay-in lugs.

FIGS. 3-6 depict a lay-in lug 300 according to an embodiment of the present invention. Lay-in lug 300 may be similar to and improve on lay-in lugs 100 and 200 of FIGS. 1 and 2. Accordingly, similar features are not described in further detail except as necessary to elucidate embodiments of the present invention.

Figure 6:
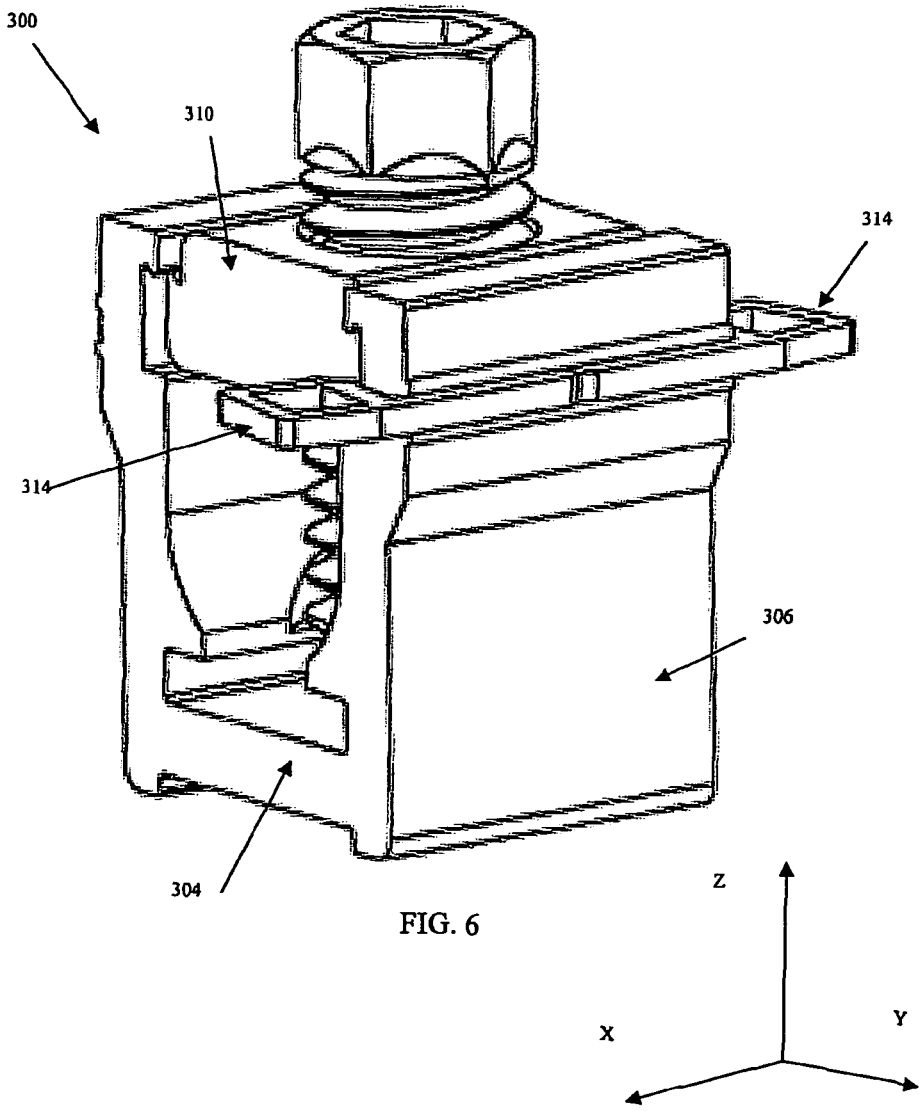
FIG. 6 is a side-front perspective view of the lay-in lug according to an embodiment of the invention.

FIG. 3 is a front perspective view of lay-in lug 300. FIG. 4 is a top view of lay-in lug 300. FIG. 5 is top-front perspective view of lay-in lug 300. FIG. 6 is a side-front perspective view of lay-in lug 300.

Lay-in lug 300 has a lug body 302 comprising a base 304 and two opposed and substantially parallel vertical lug walls 306, 308. Supported between and/or atop lug walls 306 and 308 is a removable nut plate 310, which secures a wire binding screw 312. A plate retainer 314 restricts nut plate 310 from moving in direction along lug walls 306, 308 (e.g., along the X axis). With nut plate 310 secured by lug walls 306, 308 and/or restricted by plate retainer 314, wire binding screw 312 biases a wire 316 in channel 318 against base 304.

Lay-in lug 300 may be formed and/or manufactured (e.g., extruded, cast, punched, etc.) using any appropriate material. In some embodiments, base 304 and/or lug body 302 may be constructed of conductive material. In the same or alternative embodiments, base 304 and/or lug body 302 may be plated with a conductive material. Body 302 and base 304 may be formed as a single component or may be manufactured separately and attached to each other.

Figure 2:
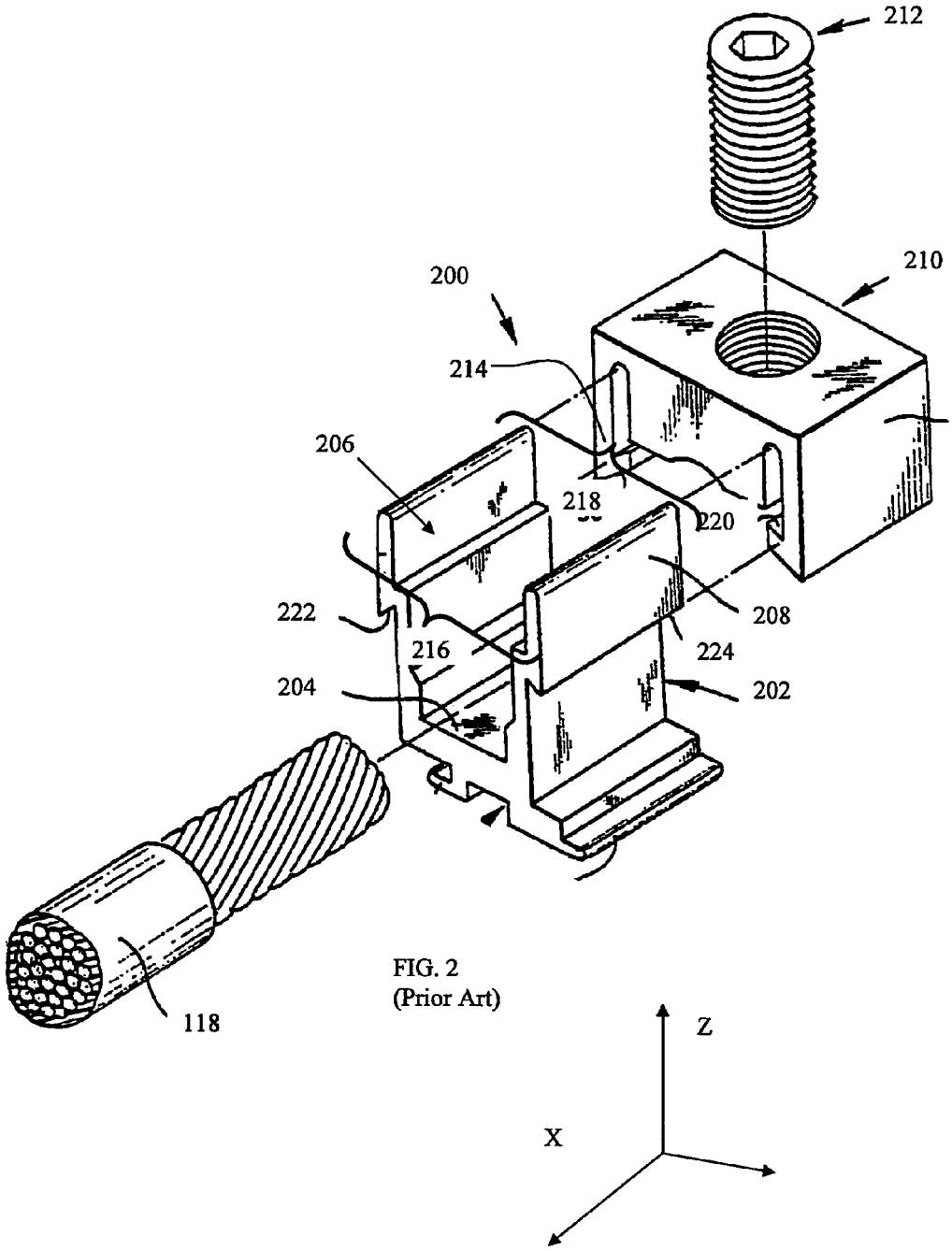
FIG. 2 (Prior Art)
FIG. 2 is a top-front perspective exploded view of a prior art lay-in lug.

Lug walls 306, 308 may be constructed in any manner that allows nut plate 310 to be secured between them in the Y axis as well as constrained in the Z axis, such as the configurations of FIGS. 1 and 2. Lug walls 306 and 308 each have respective inner surfaces 320 and 322. Thus, nut plate 310 may be described as moveable and/or slideable in a direction substantially along inner surfaces 320, 322 toward and/or away from unconstrained open ends 324, 326.

In some embodiments, lug walls 306, 308 may have recessed wall channels 328, 330. Nut plate 310 may sit in, be supported in, and/or be moveably and/or slideably arranged in and/or on wall channels 328, 330. As depicted in FIGS. 3, 5, and 6, wall channels 328, 330 may be closed channels that have some portion of lug walls 306, 308 overhanging edges of nut plate 310. In other embodiments, wall channels 328, 330 may be open channels with no portion of lug walls 306, 308 above nut plate 310 in the Z axis and nut plate 310 may be secured between lug walls 306, 308 in a tight fitting relationship (e.g., the spacing between opposed walls 306, 308 is slightly smaller than the width of nut plate 310 in the Y axis). In the same or alternative embodiments, wall channels 328, 330 may have wall flanges 332, 334 that may interlock with and/or otherwise engage a portion of nut plate 310, such as nut plate flanges 336, 338.

Additionally, respective outer surfaces 340, 342 of lug walls 306, 308 may have retainer channels 344, 346 formed thereon. In some embodiments, retainer channels 344, 346 may be recessed into outer surfaces 340, 342 of lug walls 306, 308. In the same or alternative embodiments, retainer channels 344, 346 may have one or more raised surfaces (e.g., bumps, flanges, etc.) extending from outer surfaces 340, 342. Retainer channels 344, 346 may guide, hold, secure, and/or otherwise restrain plate retainer 314 in a preferred position along outer surfaces 340, 342. That is, retainer channels 344, 346 may provide a means to guide a portion of plate retainer 314 at a predetermined height in the Z direction.

Nut plate 310 may be a removable component formed and/or manufactured of a similar material to lug body 302. Nut plate 310 may be tapped to accommodate wire binding screw 312. In some embodiments, nut plate 310 may have a slightly smaller length (e.g., along the X axis) than the length (e.g., along the X axis) of lug walls 306, 308. In this way, nut plate 310 may allow plate retainer 314 to overhang and/or otherwise impinge on a wall channel 328, 330 and restrict movement of nut plate 310 as will be described in further detail below with respect to FIGS. 7 and 8.

Plate retainer 314 is a mechanism for restricting movement of the nut plate 310 along the X axis. Plate retainer 314 may be a fastener such as a spring clip or circlip and may restrict movement at both ends of nut plate 310 along the X axis (e.g., portions of nut plate 310 oriented toward open ends 324, 326). Plate retainer 314 may be transposed along and/or in retainer channel 344, 346 and at least a portion of plate retainer 314 overhangs into a wall channel 328, 330 and/or center channel 318. As a result, plate retainer 314 prevents nut plate 310 from sliding out of lug body 302 in the unconstrained direction (e.g., positive or negative X axis). Further details of plate retainers similar to plate retainer 314 are discussed below with respect to FIGS. 7 and 8.

Figure 7:
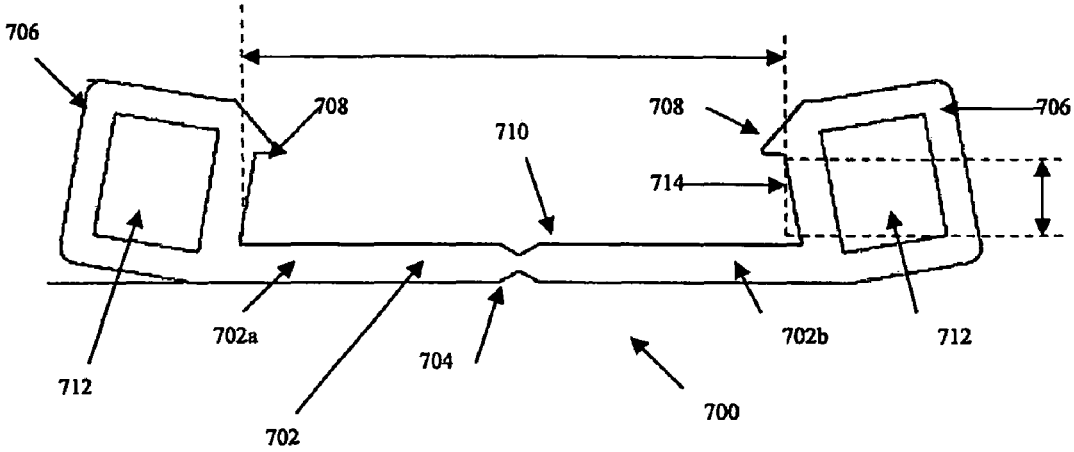
FIG. 7 depicts a top view of a plate retainer according to an embodiment of the present invention.
Figure 8:
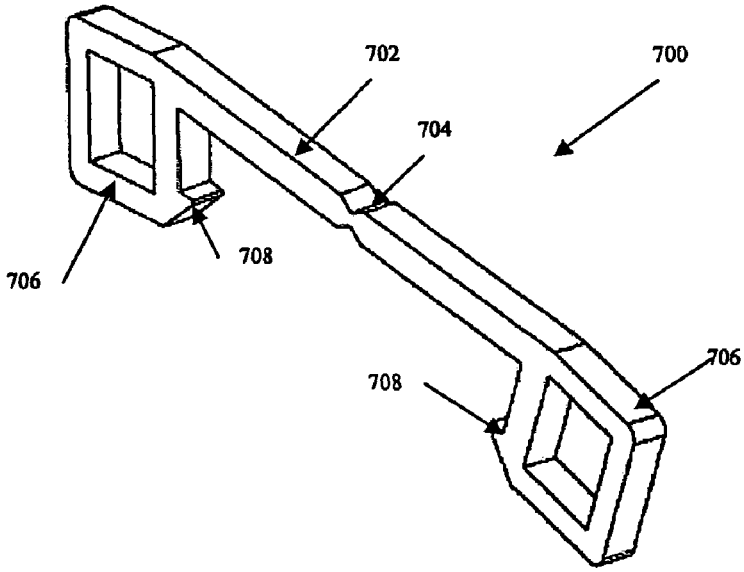
FIG. 8 depicts a top-side perspective view of the plate retainer according to an embodiment of the invention.

FIG. 7 depicts a top view of a plate retainer 700 according to an embodiment of the present invention. FIG. 8 depicts a top-side perspective view of plate retainer 700. Plate retainer 700 may be used as plate retainer 314 and accordingly is discussed herein in relation to lay-in lug 300 and FIGS. 3-6 where appropriate. Plate retainer 700 has a retaining base 702, which may have one or more indentations or notches 704. In some embodiments, notch 704 is located at approximately the center of the length of retaining base 702, dividing retaining base 702 into two portions 702*a* and 702*b*. At each end of retaining base 702 is a retaining leg 706. Each retaining leg 706 has a snap protrusion 708 extending therefrom.

Plate retainer 700 may be formed as a single component or may comprise separate base 702, retaining legs 706, and/or snap protrusions 708. Plate retainer 700 and its constituent components may be formed from a flexible or semi-flexible material, such as thermoplastic. As a result, plate retainer 700 may fit around a lug wall 306, 308 in a flexible but tight fitting relationship such that a portion of plate retainer 700 (e.g., retaining legs 706, etc.) exerts a force against an open end 324, 326 edge of a lug wall 306, 308 in a direction substantially along the lug wall (e.g., along the X axis). In this way, plate retainer 700 exerts a force in one direction along the lug wall (e.g., in the positive X direction) as well as exerting a force in a substantially opposite direction along the lug wall (e.g., in the negative X direction). This secures plate retainer 700 to lug wall 306, 308 as well as restricting movement of nut plate 310.

As will be understood from the description herein and the associated figures, the exact direction of the forces applied by the plate retainer 700 are not depicted. Based on the orientation and arrangement of certain portions of plate retainer 700 (e.g., retaining legs 706, snap protrusions 708, etc.) the resultant forces exerted on the lug body 302 and/or the nut plate 310 may differ slightly. One of skill in the art would recognize the plate retainer 700 restricts movement of the nut plate 310 as depicted in FIGS. 3-6 without confining the present invention to a specific point of contact or force direction.

Flexible retaining base 702 may be a flexible (e.g., thermoplastic) bar or member with an inner surface 710 that is, in some embodiments, approximately the same length as the length of an outer surface of a lug wall (e.g., outer surface 340, 342) along the X axis (e.g., in a direction substantially parallel to the direction of movement of nut plate 310). In alternative embodiments, inner surface 710 may be slightly shorter than an outer surface of lug wall 306, 308. In these embodiments, retaining legs 706 and/or retaining base 702 may flex to snap fit plate retainer 700 against and/or pinch an edge (e.g., at open end 324, 326, etc.) of nut plate 310.

Retaining base 702 may be more flexible at notch 704. In this way, a retaining base portion (e.g., portion 702*a*) and/or an end of retaining base 702 (e.g., one of retaining legs 706) may be moved independently of the other retaining base portion (e.g., portion 702*b*) and/or the other end of retaining base 702 (e.g., the other of retaining legs 706). Thus, a user may move one part or end of plate retainer 700 away from lug 300 while the other part remains secured to the lug wall 306, 308, restricting nut plate 310 at that end.

In some embodiments, retaining legs 706 may be shaped as open members (e.g., squares, rectangles, circles, etc.) as depicted in FIGS. 7 and 8. In these embodiments, retaining legs 706 form openings 712. Openings 712 may be of sufficient size to allow a tool (e.g., screwdriver, pen, rod, etc.) or tool tip to enter the opening 712 to allow a user to manipulate plate retainer 700. In alternative embodiments, retaining legs 706 may be formed in other appropriate shapes, such as a flat grip (e.g., for grasping by a user).

Retaining legs 706 may be flexible members with inner surfaces 714 that are, in some embodiments, approximately the same length as the width of an edge surface of a lug wall (e.g., lug walls 306, 308 at open end 324 or 326) along the Y axis (e.g., in a direction substantially perpendicular to lug walls 306, 308 and the direction of movement of nut plate 310). In alternative embodiments, inner surface 714 may be slightly shorter than an edge surface of lug wall 306, 308. In these embodiments, retaining legs 706 and/or retaining base 702 may flex to snap fit plate retainer 700 against and/or pinch an edge (e.g., at the opening end) of nut plate 310.

Snap protrusions 708 may be extensions of or may extend from retaining legs 706 for a predetermined distance. In some embodiments, snap protrusions 708 are sufficiently large to extend into wall channels 328, 330 and thus restrict movement of plate retainer 700 away from lug body 302 (e.g., in the Y axis). That is, if the plate retainer 314 depicted in FIG. 3 is pulled in the positive Y direction, snap protrusions 708 will, at least until an overwhelming force is exerted, prevent plate retainer 700 from being pulled away from lug wall 306. Further, snap protrusions 708 provide a stop against which nut plate 310 may contact if it moves sufficiently far in a direction along lug walls 306, 308. In other words, snap protrusions 708 may restrict movement of nut plate 310 along the X axis by serving as a stop, guard, chock, etc. In some embodiments, nut plate 310 does not contact either snap protrusion 708. In alternative embodiments, snap protrusions 708 extend sufficiently far to exert a force against nut plate 310 in a direction substantially parallel to inner surfaces 320, 322 of lug walls 306, 308 and to exert an opposite force against an opposite end of nut plate 310 in a direction substantially parallel to inner surfaces 320, 322 of lug walls 306, 308. That is, snap protrusions may pinch or clip nut plate 310 to restrict its movement along the X axis. In the same or alternative embodiments, snap protrusions 708 may exert a force in a direction substantially perpendicular to the lug walls 306, 308 (e.g., in the positive Y direction) as snap protrusions 708 and retaining base 702 clip and/or pinch lug wall 306, 308.

Though described herein as extensions from retaining legs 706, snap protrusions 708 may be of any appropriate shape and/or size to facilitate restriction of movement of nut plate 310 as described herein. For example, snap protrusions 708 may have an additional protrusion and/or be shaped in such a way as to hook around, interlock, or otherwise engage a portion of lug wall 306, 308 and/or nut plate 310 similar to the interlock of flanges 332-338 described above.

In operation, lay-in lug 300 is secured to a surface (not shown) at and/or by its base 304 (e.g., using mounting apparatus, etc.). In vertical installation operations, lay-in lug 300 is secured such that "open" ends 324 and 326 (e.g., sides of lug body 302 not dominated by a lug wall 306, 308) face substantially up and down, respectively (e.g., toward negative X and positive X, respectively). That is, lug walls 304 and 306 will be generally parallel to the direction of a gravity vector G and a secured wire 316. Nut plate 310, with wire binding screw 312 secured thereto, is removed from between lug walls 306, 308. This provides top down (e.g., positive Z to negative Z) access to the center channel 318 of lug body 302. Wire 316 (e.g., electrical cable, wiring, etc.) is laid in, pulled through, or otherwise transposed in the center channel 318 of lug body 302 between lugs walls 306 and 308, generally along the X axis. Nut plate 310 is returned to placement between and/or on top of lug walls 306, 308 by sliding nut plate 310 along wall channels 328, 330 and interlocking flanges 332-338. Wire binding screw 312 is torqued (e.g., screwed, driven, etc.) to secure wire 316 between base 304 and wire binding screw 312 in the Z direction. Wire 316 is further secured laterally (e.g., in the Y direction) by lug walls 306, 308.

Plate retainer 314/700 is clipped to lug body 302. Retaining base 702 is set into a retainer channel 344, 346 and retaining legs are secured around a portion (e.g., a portion at an open end 324, 326) of a lug wall 306, 308. Snap protrusions 708 exert a force on an inner surface 318, 322 (generally inside a wall channel 328, 330) and/or retaining legs 306 exert a force on the end portion of the lug wall 306, 308. In this way, plate retainer 314/700 is secured to, clipped to, pinching, etc. a lug wall 306, 308. Plate retainer 317/700 thus serves as a stop which restricts the movement of nut plate 310 along the walls 306, 308. In practice, only one plate retainer 314/700 may be used. However, any number and/or arrangement of plate retainers 314/700 may be used. For example another plate retainer may be similarly attached on the opposing lug wall 306, 308, a plate retainer 314/700 may be placed without guidance from a retainer channel 344, 346, a plate retainer 314/700 may contact and exert forces on the nut plate 310 to further restrict movement, etc.

The foregoing Detailed Description is to be understood as being in every respect illustrative and exemplary, but not restrictive, and the scope of the invention disclosed herein is not to be determined from the Detailed Description, but rather from the claims as interpreted according to the full breadth permitted by the patent laws. It is to be understood that the embodiments shown and described herein are only illustrative of the principles of the present invention and that various modifications may be implemented by those skilled in the art without departing from the scope and spirit of the invention. Those skilled in the art could implement various other feature combinations without departing from the scope and spirit of the invention.

The invention claimed is:

1. A lay-in lug comprising:

a first lug wall;

a second lug wall spaced apart from and substantially parallel to the first lug wall;

a plate supported between the first lug wall and the second lug wall; and a retaining clip configured to exert force on the first lug wall and restrict the plate from moving in a direction substantially along the first and second lug walls relative to at least one open end of the lay-in lug.

2. The lay-in lug of claim 1 further comprising:

a first wall channel formed in the first lug wall;

a second wall channel formed in the second lug wall; and wherein the plate is slideably supported in first and second wall channels and the retaining clip is configured to restrict the plate from sliding along first and second wall channels.

3. The lay-in lug of claim 1 wherein the retaining clip is configured to exert force in a first direction on a first portion of the first lug wall and to exert force in a second direction substantially opposite the first direction on a second portion of the first lug wall.

4. The lay-in lug of claim 3 wherein the retaining clip is configured to exert force in the first direction on a first end of the plate and to exert force in the second direction on a second end of the plate.

5. The lay-in lug of claim 3 wherein the retaining clip comprises:

a first retaining leg configured to exert the first force on a first end of the first lug wall and the first direction is substantially parallel to an inner surface of the first lug wall; and a second retaining leg configured to exert the second force on a second end of the first lug wall.

6. The lay-in lug of claim 1 wherein the retaining clip comprises:

a first protrusion configured to exert a first force on an inner surface of the first lug wall substantially perpendicular to the first lug wall; and a second protrusion configured to exert a second force on the inner surface of the first lug wall substantially perpendicular to the first lug wall.

7. The lay-in lug of claim 1 further comprising:

a retaining clip channel at an outer surface of the first lug wall configured to provide a guide for positioning the retaining clip.

8. A plate retainer for preventing a nut plate of a lay-in lug from moving along a wall of the lay-in lug comprising:

a flexible retaining base;

a first retaining leg extending from a first section of the retaining base;

a first snap protrusion extending from the first retaining leg and formed to interlock with a portion of the wall of the lay-in lug and restrict movement of a first end of the nut plate;

a second retaining leg extending from a second section of the retaining base; and a second snap protrusion extending from the second retaining leg and formed to interlock with a portion of the wall of the lay-in lug and restrict movement of a second end of the nut plate.

9. The plate retainer of claim 8 wherein the first snap protrusion is configured to exert force on a surface of the wall of the lay-in lug at a first end and the second snap protrusion is configured to exert a force on the surface of the wall of the lay-in lug at a second end, the forces substantially perpendicular to the surface of the wall.

10. The plate retainer of claim 8 wherein the first retaining leg is configured to exert force on a first end of the wall and the second retaining leg is configured to exert force on the second end of the wall, the forces exerted in opposite directions substantially parallel to the wall.

11. The plate retainer of claim 8 wherein the first and second retaining legs are open members.

12. The plate retainer of claim 8 wherein the flexible retaining base comprises:

a notch configured to allow the flexible retaining base to bend at the notch.

13. A lay-in lug comprising:

a first lug wall;

a second lug wall spaced apart from and substantially parallel to the first lug wall;

a plate supported between the first lug wall and the second lug wall; and a retaining means configured to exert force on the first lug wall and restrict the plate from moving in a direction substantially along the first and second lug walls.

14. The lay-in lug of claim 13 further comprising:

a first wall channel formed in the first lug wall;

a second wall channel formed in the second lug wall; and wherein the plate is slideably supported in first and second wall channels and the retaining means is further configured to restrict the plate from sliding along first and second wall channels.

15. The lay-in lug of claim 13 wherein the retaining means is further configured to exert force in a first direction on a first portion of the first lug wall and to exert force in a second direction substantially opposite the first direction on a second portion of the first lug wall.

16. The lay-in lug of claim 15 wherein the retaining means is further configured to exert force in the first direction on a first end of the plate and to exert force in the second direction on a second end of the plate.

17. The lay-in lug of claim 15 wherein the retaining means comprises:

a first retaining member configured to exert the first force on a first end of the first lug wall and the first direction is substantially parallel to an inner surface of the first lug wall; and a second retaining member configured to exert the second force on a second end of the first lug wall.

18. The lay-in lug of claim 13 wherein the retaining means comprises:

a first snap means configured to exert a first force on an inner surface of the first lug wall substantially perpendicular to the first lug wall; and a second snap means configured to exert a second force on the inner surface of the first lug wall substantially perpendicular to the first lug wall.

19. The lay-in lug of claim 13 further comprising:

a retaining means channel at an outer surface of the first lug wall configured to provide a guide for positioning the retaining means.

* * * * *